US011761294B2

(12) United States Patent
Vasques

(10) Patent No.: US 11,761,294 B2
(45) Date of Patent: Sep. 19, 2023

(54) ANNULAR BARRIER AND DOWNHOLE SYSTEM

(71) Applicant: WELLTEC OILFIELD SOLUTIONS AG, Zug (CH)

(72) Inventor: Ricardo Reves Vasques, Zug (CH)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 0 days.

(21) Appl. No.: 17/669,873

(22) Filed: Feb. 11, 2022

(65) Prior Publication Data

US 2022/0259940 A1 Aug. 18, 2022

(30) Foreign Application Priority Data

Feb. 12, 2021 (EP) ..... 21156921

(51) Int. Cl.
*E21B 33/128* (2006.01)
*E21B 33/127* (2006.01)

(52) U.S. Cl.
CPC ..... *E21B 33/128* (2013.01); *E21B 33/127* (2013.01); *E21B 33/1272* (2013.01); *E21B 33/1285* (2013.01)

(58) Field of Classification Search
CPC .. E21B 33/128; E21B 33/127; E21B 33/1272; E21B 33/1285
See application file for complete search history.

(56) References Cited

U.S. PATENT DOCUMENTS

| | | | | |
|---|---|---|---|---|
| 10,551,091 | B2 | 2/2020 | Krüger | |
| 10,667,013 | B2 * | 5/2020 | Peng | H04N 21/239 |
| 10,844,686 | B2 * | 11/2020 | Hallundbæk | E21B 33/1277 |
| 11,142,987 | B2 * | 10/2021 | Vasques | E21B 33/1243 |
| 2019/0383114 | A1 | 12/2019 | Vasques | |
| 2020/0248530 | A1 * | 8/2020 | Kumar | E21B 34/10 |

FOREIGN PATENT DOCUMENTS

WO 2015/169959 11/2015

OTHER PUBLICATIONS

Extended Search Report for EP21156921.5, dated Jul. 23, 2021, 8 pages.

* cited by examiner

*Primary Examiner* — Yong-Suk (Philip) Ro
(74) *Attorney, Agent, or Firm* — Nixon & Vanderhye P.C.

(57) ABSTRACT

An expandable annular barrier includes a tubular metal part, an expandable metal sleeve surrounding the tubular metal part, and an expandable space therebetween. The metal sleeve has a first thickness, an expansion opening in the tubular metal part through which fluid enters in order to expand the metal sleeve, and a valve assembly having a first opening fluidly connected with the first zone in the expanded condition of the annular barrier, a second opening fluidly connected with the second zone through a fluid channel between the tubular metal part and the metal sleeve, and a third opening fluidly connected with the expandable space. The fluid channel has an extension along a circumference of the tubular metal part being at least 5% of the circumference of the tubular metal part.

18 Claims, 3 Drawing Sheets

ANNULAR BARRIER AND DOWNHOLE SYSTEM

Figure 1:
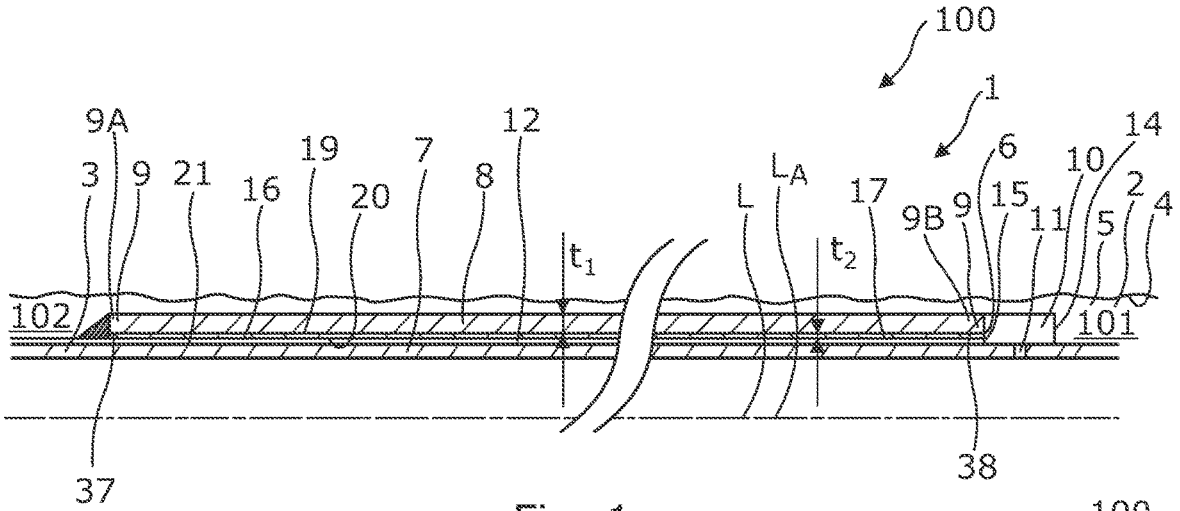

This application claims priority to EP Patent Application No. 21156921.5 filed 12 Feb. 2021, the entire contents of which is hereby incorporated by reference.

The present invention relates to an annular barrier to be expanded in an annulus between a well tubular metal structure and an inside wall of a borehole downhole to an expanded condition of the annular barrier. The invention also relates to a downhole system comprising at least one annular barrier and the well tubular metal structure.

Annular barriers are used downhole for providing isolation of a first zone from a second zone in an annulus in a borehole of a well between a well tubular metal structure and the borehole wall or another well tubular metal structure.

When expanded, annular barriers may be subjected to continuous pressure or periodically high pressure from outside, either in the form of hydraulic pressure within the well environment or in the form of formation pressure. In some circumstances, such pressure may cause the expanded metal sleeve of the annular barrier to collapse, which may have severe consequences for the zonal isolation provided by the barrier, as the sealing properties are lost due to the collapse.

The ability of the expanded sleeve of an annular barrier to withstand the collapse pressure is thus affected by many variables, such as material strength, wall thickness, surface area exposed to the collapse pressure, temperature, well fluids, etc. However, the thicker the expandable metal sleeve, the more expansion pressure is required to expand the sleeve, and other completion components cannot withstand such high expansion pressure. Thus, the annular barriers are provided with a valve system fluidly connected with both the first zone, the second zone and the space underneath the expanded metal sleeve of the annular barrier, so that the space is always pressure-equalised with the higher of the pressure in the first and the second zone. In order for the valve system to be fluidly connected with both the first zone and the second zone, a hydraulic tube T is arranged between the expandable metal sleeve and the well tubular metal structure, around which the expandable metal sleeve extends. However, such hydraulic tube T is insufficient for some well applications where the clearance between the borehole and the well tubular metal structure is very small and there is no room for the hydraulic tube. In such applications, two annular barriers are arranged "back-to-back", i.e. next to each other, so that one of the annular barriers pressure-equalises its space pressure with the pressure in the first zone, and the other annular barrier pressure-equalises its space pressure with the pressure in the second zone, and none of the annular barriers are pressure-equalising with the zone between the annular barriers. However, such "back-to-back" solution is expensive as two annular barriers are required.

It is an object of the present invention to wholly or partly overcome the above disadvantages and drawbacks of the prior art. More specifically, it is an object to provide an improved annular barrier which does not collapse, without having to increase the thickness of the expandable metal sleeve, and which is sufficient for all well applications, i.e. independently of the clearance between the borehole and the well tubular metal structure.

The above objects, together with numerous other objects, advantages and features, which will become evident from the below description, are accomplished by a solution in accordance with the present invention by an annular barrier to be expanded in an annulus between a well tubular metal structure and an inside wall of a borehole downhole to an expanded condition of the annular barrier providing zone isolation between a first zone and a second zone of the borehole, the annular barrier having an unexpanded condition, and the expanded condition comprising:

- a tubular metal part for mounting as part of the well tubular metal structure,
- an expandable metal sleeve surrounding the tubular metal part, each end of the expandable metal sleeve being connected with the tubular metal part defining an expandable space, the expandable metal sleeve having a first thickness,
- an expansion opening in the tubular metal part through which fluid enters in order to expand the expandable metal sleeve, and
- a valve assembly having a first opening fluidly connected with the first zone in the expanded condition of the annular barrier, a second opening fluidly connected with the second zone through a fluid channel between the tubular metal part and the expandable metal sleeve, and a third opening fluidly connected with the expandable space, wherein the fluid channel has an extension along a circumference of the tubular metal part being at least 5% of the circumference of the tubular metal part.

Furthermore, the fluid channel may be provided by a wall arranged between the expandable metal sleeve and the tubular metal part.

Further, the wall may be sheet-shaped.

Moreover, the fluid channel may be provided by a sheet-shaped wall arranged between the tubular metal part and the expandable metal sleeve, each end of the sheet-shaped wall being arranged between the tubular metal part and each end of the expandable metal sleeve, respectively.

Thus, the fluid channel may be provided by a sheet-shaped wall arranged between the tubular metal part and the expandable metal sleeve, each end of the wall being arranged between the tubular metal part and each end of the expandable metal sleeve, respectively.

Furthermore, the expandable metal sleeve may have a first length along the longitudinal extension, the wall having a second length along the longitudinal extension, the second length being equal to or larger than the first length.

In addition, the wall may have an axial extension along the longitudinal extension being longer than the circumference of the tubular metal part.

Also, the wall may have a circumferential extension being at least 10% of the circumference of the tubular metal part, preferably at least 25% of the circumference of the tubular metal part.

Further, each end of the wall may be arranged between each end of the expandable metal sleeve and the tubular metal part, so that one end of the wall is arranged between one end of the expandable metal sleeve and the tubular metal part, and another end of the wall being arranged between the other end of the expandable metal sleeve and the tubular metal part.

Additionally, the wall may extend underneath the expandable metal sleeve from end to end, the fluid channel being underneath the wall.

Moreover, the fluid channel may have an extension along a circumference of the tubular metal part being at least 10% of the circumference of the tubular metal part, preferably at least 25% of the circumference of the tubular metal part, and more preferably at least 50% of the circumference of the tubular metal part.

By having at least a partly annular fluid channel, a hydraulic tube is no longer needed to provide the fluid channel for equalising the pressure in the space in the annular barrier with the pressure in both the first and the second zone. The hydraulic tube takes up more space in the radial direction than a partly annular fluid channel, and thus the overall outer diameter of the annular barrier is substantially reduced compared to using a hydraulic tube extending between the tubular metal part and the expandable metal sleeve.

Also, the valve assembly may comprise a fourth opening fluidly connected with the expansion opening.

Furthermore, the wall may have a second thickness being smaller than the first thickness.

Additionally, the fluid channel may be provided by a wall having a second thickness being smaller than the first thickness.

Also, the fluid channel may be provided by a wall being at least partly tubular and surrounding the tubular metal part.

By having the wall between the expandable metal sleeve and the tubular metal part, a simple, partly annular fluid channel is provided by only one wall thickness compared to the hydraulic tube providing the fluid channel by two times the wall thickness when seen in the radial direction of the annular barrier.

In addition, the wall may extend along at least part of the circumference of the tubular metal part and along an axial extension of the tubular metal part.

Further, the fluid channel may be provided by a tubular sleeve having the wall surrounding the tubular metal part and being within the expandable metal sleeve, providing the fluid channel.

In that way, the wall encloses the at least partly annular fluid channel with only one wall thickness and not twice the wall thickness as compared to the known hydraulic tube.

Also, the annular barrier may only have one wall thickness between the expandable metal sleeve and the tubular metal part.

Furthermore, the annular barrier may only have one wall between the expandable metal sleeve and the tubular metal part extending all the way around the tubular metal part.

Moreover, the tubular sleeve may be immobile at least after expansion of the expandable metal sleeve.

Also, during expansion, the tubular sleeve may not expand with the expandable metal sleeve.

Furthermore, the fluid channel may be arranged between the tubular sleeve and the tubular metal part, and the expandable metal sleeve may surround the tubular sleeve defining the expandable space between the expandable metal sleeve and the tubular sleeve, and the valve assembly may control a pressure in the expandable space.

In addition, the second thickness may be between 1-5 mm, preferably between 1-3 mm.

Further, the second thickness may be 50% smaller than the first thickness.

Moreover, the wall may have an outer face and an inner face, and the inner face of the wall may be arranged at a distance of 0.5-3 mm from an outer face of the tubular metal part.

Also, the wall may have a spacer part ensuring a distance between an inner face of the wall and an outer face of the tubular metal part.

Furthermore, the wall may have a spacer part ensuring a distance between an inner face of the wall and an outer face of the tubular metal part also when the expandable metal sleeve is expanded by pressurising the space between the wall and the expandable metal sleeve.

In addition, the spacer part may be a welded seam.

Further, the spacer part may be one or more indentations.

Moreover, the indentations may be made by stamping.

Also, the indentations may be distributed at least along the longitudinal extension of the tubular metal part.

Furthermore, the fluid channel may be an annular fluid channel.

In addition, the fluid channel may be an annular fluid channel when seen in cross-section.

Further, the wall may be only partly surrounding the tubular metal part and may be connected to the tubular metal part along a longitudinal extension of the tubular metal part.

Moreover, the fluid channel may have a moon-shaped cross-section.

Furthermore, the pressure in the fluid channel is equal to the pressure in the second zone.

In addition, the pressure in the expandable space between the expandable metal sleeve and the wall is always higher than or equal to the pressure in the fluid channel.

Also, the annular barrier may comprise a first connection part connecting the expandable metal sleeve to the tubular metal part, the first connection part comprising a first conduit fluidly connecting the third opening of the valve assembly and the expandable space, and the first connection part comprising a second conduit fluidly connecting the second opening of the valve assembly and the fluid channel.

Furthermore, the first connection part may connect the expandable metal sleeve and the wall to the tubular metal part.

In addition, the second connection part may connect the expandable metal sleeve and the wall to the tubular metal part.

Further, the first connection part may connect the expandable metal sleeve and the tubular sleeve to the tubular metal part.

Moreover, the second connection part may connect the expandable metal sleeve and the tubular sleeve to the tubular metal part.

Also, the annular barrier may comprise a second connection part connecting the expandable metal sleeve to the tubular metal part, the second connection part comprising a third conduit fluidly connecting the fluid channel and the second zone.

Furthermore, the third conduit may be in fluid communication with the second zone at one end and fluidly connected to the fluid channel at the other end, the fluid channel being fluidly connected to the second conduit, and the second conduit being fluidly connected to the second opening of the valve assembly.

In addition, the expandable space between the expandable metal sleeve and the tubular metal part may be fluidly connected to the first conduit, the first conduit being fluidly connected to the first opening, which is fluidly connected with the first zone in the expanded condition of the annular barrier.

Further, the fourth opening may be fluidly connected with the expandable space during expansion of the expandable metal sleeve, and after expansion the fourth opening may be fluidly disconnected from the expandable space.

Moreover, the valve assembly may comprise a first position in which the first opening is fluidly connected with the expandable space and a second position in which the second opening is fluidly connected with the expandable space.

Also, in the first position, the pressure in the first zone may be higher than the pressure in the second zone, and in the second position the pressure in the second zone may be higher than the pressure in the first zone.

Furthermore, in the first position and in the second position, the fourth opening may be fluidly disconnected from the expansion opening.

In addition, the valve assembly may be a pressure compensation valve assembly.

Further, the annular barrier may comprise a first screen for filtering fluid from the first zone before entering the valve assembly and/or a second screen for filtering fluid from the second zone before entering the valve assembly.

Finally, the present invention relates to a downhole system comprising at least one annular barrier and the well tubular metal structure.

Figure 2:
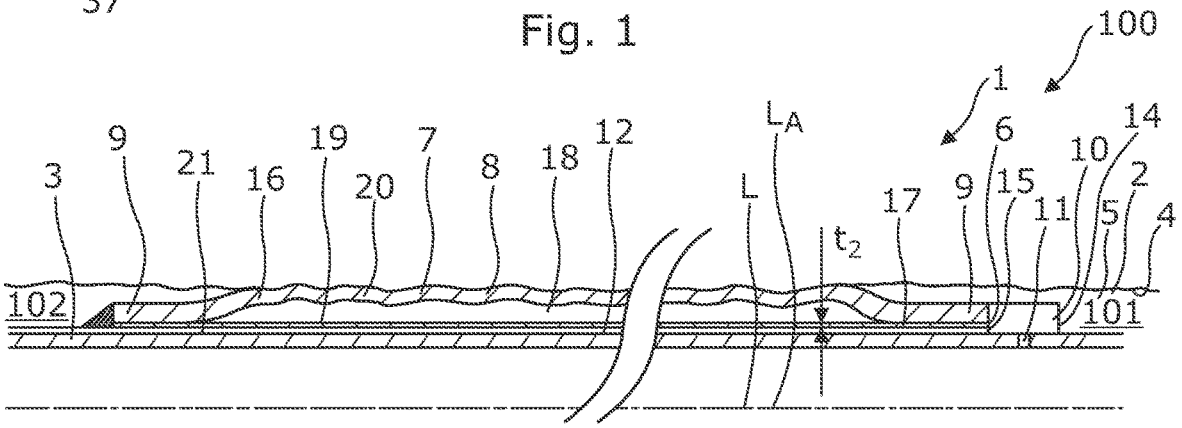
Figure 3:
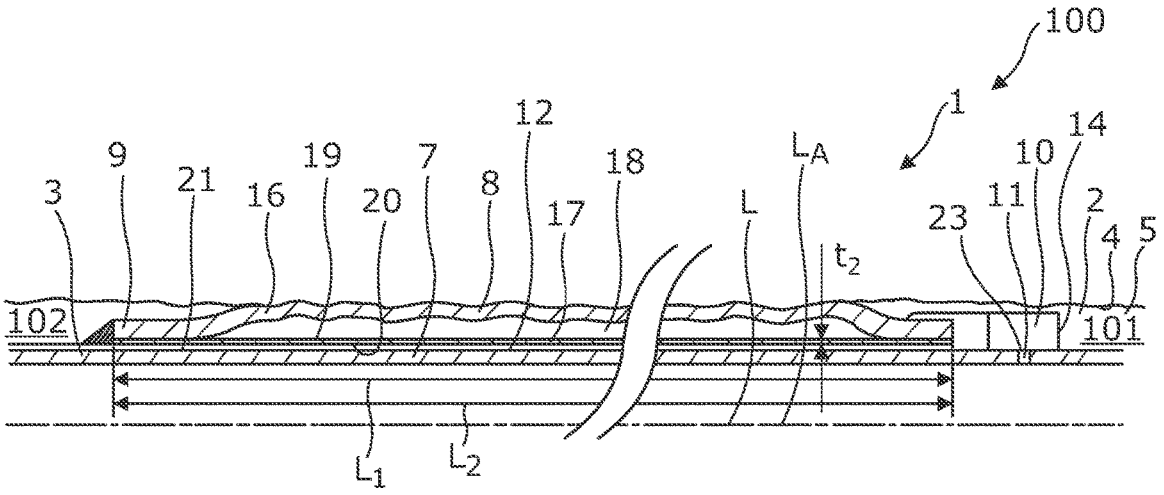
Figure 4:
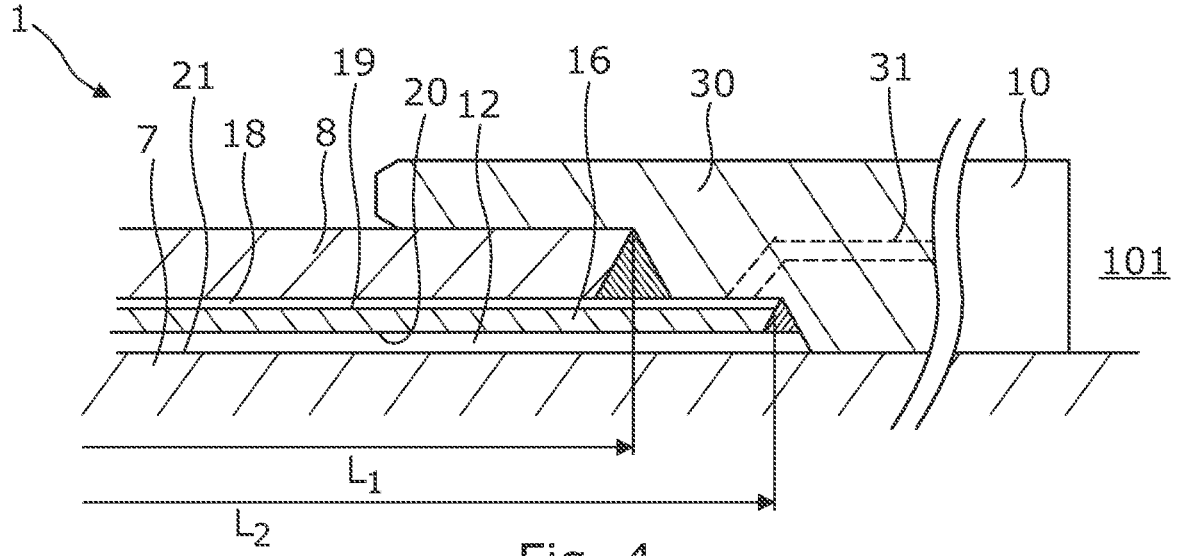
Figure 5:
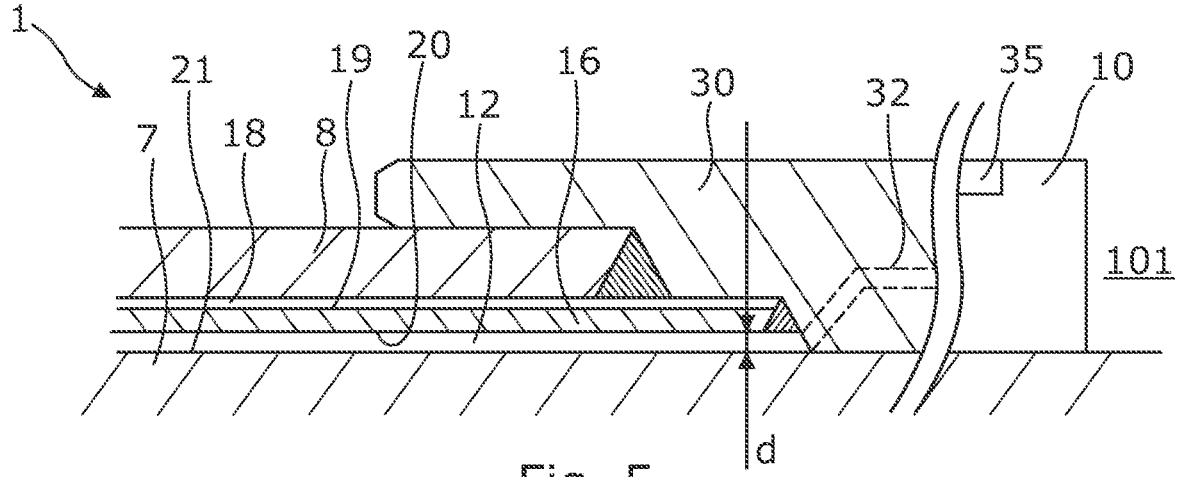
Figure 6:
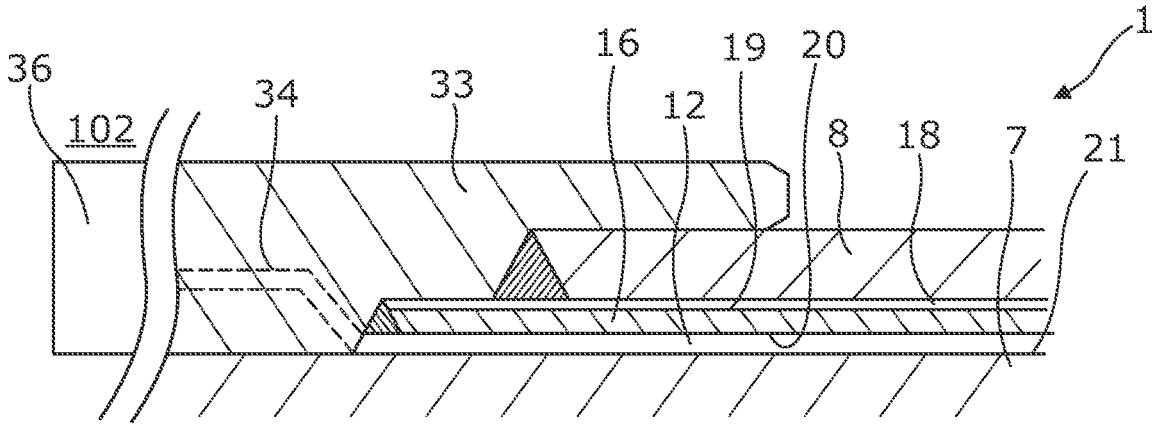
Figure 7A:
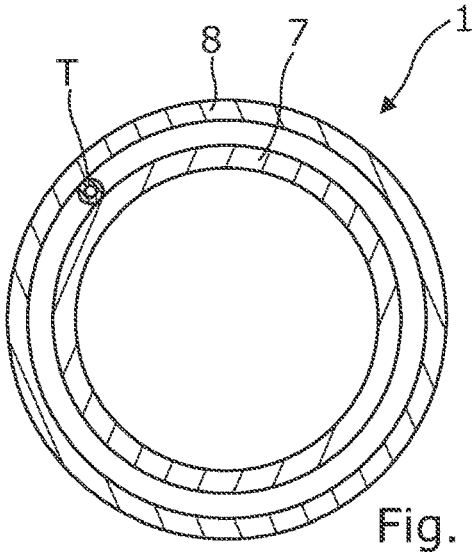
Fig. 7A (Prior Art)
Figure 7B:
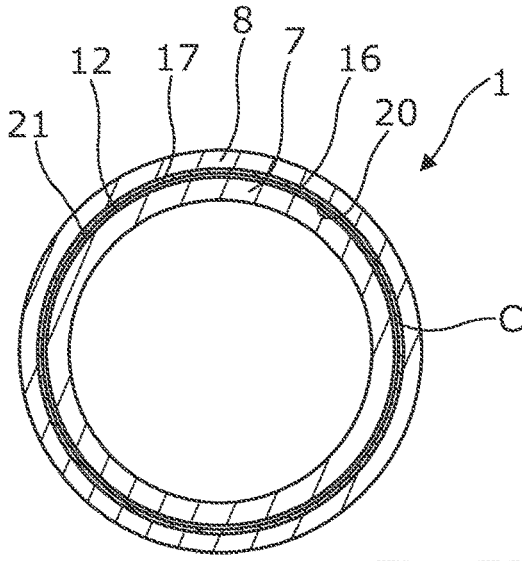
Figure 8:
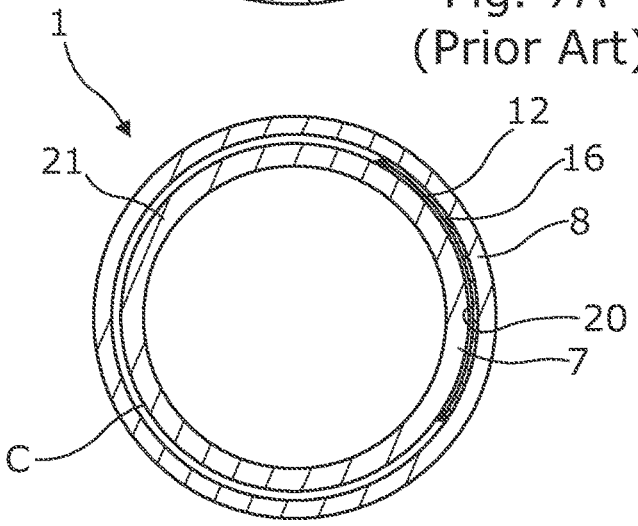
Figure 10:
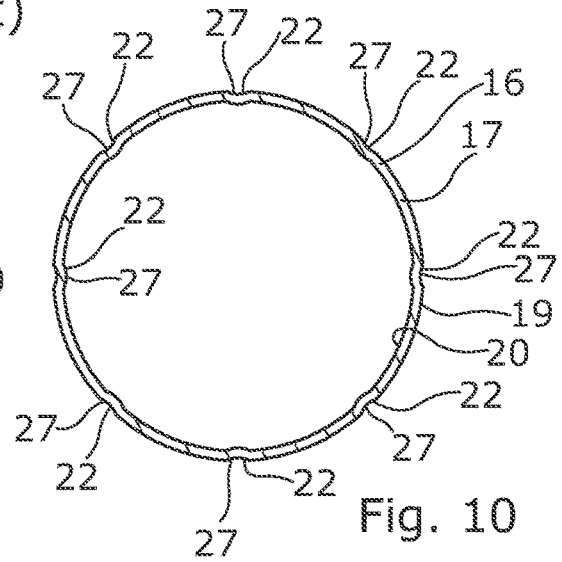
Figure 9:
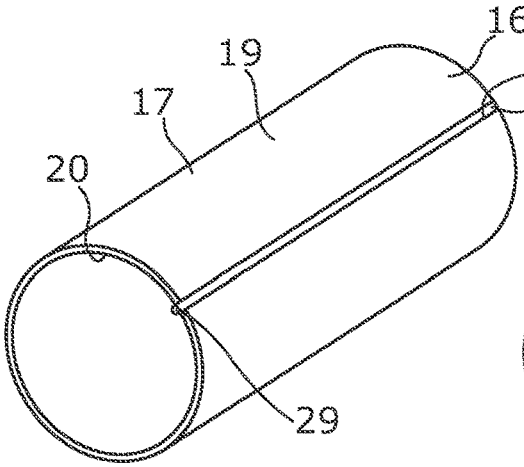
Figure 11:
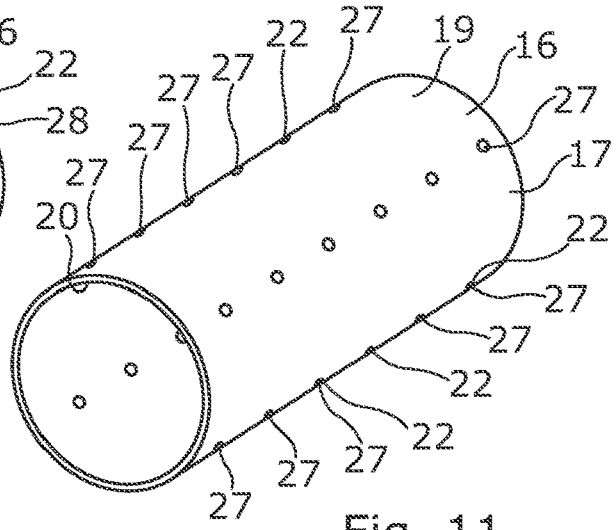

The invention and its many advantages will be described in more detail below with reference to the accompanying schematic drawings, which for the purpose of illustration show some non-limiting embodiments and in which:

FIG. 1 shows a cross-sectional view of an annular barrier according to one aspect of the invention in its unexpanded condition, FIG. 2 shows a cross-sectional view of the annular barrier of FIG. 1 in its expanded condition, FIG. 3 shows a cross-sectional view of another annular barrier, FIG. 4 shows a cross-sectional view of an end part of an annular barrier, FIG. 5 shows another cross-sectional view of the end part of FIG. 4, FIG. 6 shows a cross-sectional view of another end part of an annular barrier, FIG. 7A shows a cross-sectional view of a prior art annular barrier having a hydraulic tube through the expandable space, FIG. 7B shows a cross-sectional view of an annular barrier according to the invention having an annular fluid channel provided by a tubular sleeve, FIG. 8 shows a cross-sectional view of another annular barrier according to the invention having a partly annular fluid channel provided by a wall, FIG. 9 shows a perspective of a tubular sleeve having spacer parts in the form of a welding seam, FIG. 10 shows a cross-sectional view of a tubular sleeve having spacer parts, and FIG. 11 shows a perspective of a tubular sleeve having spacer parts in the form of indentations.

All the figures are highly schematic and not necessarily to scale, and they show only those parts which are necessary in order to elucidate the invention, other parts being omitted or merely suggested.

FIG. 1 shows an annular barrier 1 in its unexpanded condition to be expanded in an annulus 2 between a well tubular metal structure 3 and an inside wall 4 of a borehole 5 downhole to an expanded condition of the annular barrier 1 providing zone isolation between a first zone 101 and a second zone 102 of the borehole, shown in FIG. 2. The annular barrier 1 comprises a tubular metal part 7 mounted as part of the well tubular metal structure 3 and an expandable metal sleeve 8 surrounding the tubular metal part 7. Each end 9 of the expandable metal sleeve 8 is connected with the tubular metal part 7 providing an expandable space therebetween. The expandable metal sleeve 8 has a first thickness $t_1$, and the tubular metal part 7 has an expansion opening 11 through which fluid enters in order to expand the expandable metal sleeve 8 by letting the fluid into the expandable space. The annular barrier 1 further comprises a valve assembly 10 having a first opening 14 fluidly connected with the first zone 101 in the expanded condition of the annular barrier 1 and a second opening 15 fluidly connected with the second zone 102 through a fluid channel 12 between the tubular metal part 7 and the expandable metal sleeve 8. The fluid channel 12 is provided by a sheet-shaped wall 16 having a second thickness $t_2$ being smaller than the first thickness $t_1$. The sheet-shaped wall 16 extends along at least part of the circumference of the tubular metal part 7 and along an axial extension L of the tubular metal part 7. The sheet-shaped wall thus forms a tubular. The sheet-shaped wall has an axial extension LA along the longitudinal extension being longer than the circumference of the tubular metal part 7. The fluid channel 12 is provided between the sheet-shaped wall 16 and the tubular metal part 7. Each end 37, 38 of the sheet-shaped wall 16 is arranged between each of the end 9, 9A, 9B of the expandable metal sleeve 8, so that end 37 of the sheet-shaped wall 16 is arranged between the end 9A of the expandable metal sleeve and the tubular metal part, and end 38 of the sheet-shaped wall 16 is arranged between the end 9B of the expandable metal sleeve and the tubular metal part. The sheet-shaped wall 16 thus extends underneath the expandable metal sleeve from end to end and the fluid channel underneath the sheet-shaped wall 16 is fluidly connecting the second opening 15 of the valve assembly 10 and the second zone 102.

The fluid channel 12 is provided by a tubular sleeve 17 having the sheet-shaped wall 16 and surrounding the tubular metal part 7, and the tubular sleeve is arranged within the expandable metal sleeve 8, providing the fluid channel 12. Thus, the fluid channel 12 is arranged between the tubular sleeve 17 and the tubular metal part 7, and the expandable metal sleeve 8 surrounds the tubular sleeve 17, defining the expandable space 18 between the expandable metal sleeve 8 and the tubular sleeve 17. The valve assembly 10 controls the pressure in the expandable space 18 so that in an expansion position, the valve assembly fluidly connects the expansion opening 11 and the expandable space.

As can be seen, only a wall and thus one wall thickness, i.e. the second thickness $t_2$, is necessary for providing the fluid channel 12, and thus the overall diameter of the annular barrier 1, as shown in FIG. 7B, when seen in cross-section is substantially smaller than when having a hydraulic tube T (shown in FIG. 7A, Prior Art). The wall does not have to be able to expand as it is immobile during expansion and after expansion. The pressure in the fluid channel 12 is equal to the pressure in the second zone 102. The pressure in the expandable space 18 between the expandable metal sleeve 8 and the wall is always higher than or equal to the pressure in the fluid channel 12.

Thus, the fluid channel 12 has an extension along a circumference of the tubular metal part 7 being at least 5% of the circumference of the tubular metal part 7, and thus a partly annular fluid channel is provided. The height of the cross-sectional area of the fluid channel 12 can thus be made very small, and still the cross-sectional area of the fluid channel 12 is larger than the cross-sectional area of the hydraulic tube T, shown in FIG. 7A. The tubular metal part 7 of FIG. 7A and the tubular metal part 7 of FIG. 7B have the same dimensions, and when comparing the overall outer diameter of the expandable metal sleeve 8 in FIG. 7A with the overall outer diameter of the expandable metal sleeve 8 in FIG. 7B, the outer diameter of the expandable metal sleeve 8 in FIG. 7A is much larger than the outer diameter of the expandable metal sleeve 8 in FIG. 7B in order for the expandable metal sleeve 8 in FIG. 7A to provide space for the hydraulic tube T. However, the cross-sectional flow area of the hydraulic tube T in FIG. 7A is much smaller than the flow area of the fluid channel 12 in FIG. 7B. The fluid channel 12 is an annular fluid channel when see in cross-section as shown in FIG. 7B. Even if the fluid channel 12 is only made partly annular as shown in FIG. 8, the flow area of the fluid channel 12 in FIG. 8 is still larger than the flow area of the hydraulic tube T in FIG. 7A. The thickness $t_1$ of the expandable metal sleeve 8 remains unchanged when comparing FIG. 7A with FIG. 7B.

Thus, an improved annular barrier 1 which does not collapse, without having to increase the thickness of the expandable metal sleeve 8, and which is sufficient for all well applications, i.e. independently of the clearance between the borehole 5 and the well tubular metal structure 3, has been accomplished as the annular barrier can fit almost all well applications because the annular barrier is pressure-equalised from both sides (both the first zone 101 and the second zone 102), so there is no need for the more expensive "back-to-back" (two-annular-barriers) solution.

As shown in FIG. 3, the valve assembly 10 further comprises a fourth opening 23 fluidly connected with the expansion opening 11, so that fluid from within the well tubular metal structure 3 and the tubular metal part 7 flows through the expansion opening 11, the fourth opening 23 and the third opening 6 in the valve assembly to the expandable space 18 during expansion of the expandable metal sleeve 8. The tubular sleeve 17 is immobile at least after expansion of the expandable metal sleeve 8. During expansion, the tubular sleeve 17 does not expand with the expandable metal sleeve 8.

In FIG. 3, the expandable metal sleeve has a first length $L_1$ along the longitudinal extension L, the sheet-shaped wall has a second length $L_2$ along the longitudinal extension L, the second length $L_2$ is equal to the first length $L_1$, and in FIGS. 4-6, the second length $L_2$ is larger than the first length $L_1$.

The fluid channel 12 is provided by the wall 16 having the second thickness $t_2$ being smaller than the first thickness $t_1$ of the expandable metal sleeve 8. The second thickness $t_2$ is between 1-5 mm, preferably between 1-3 mm. The second thickness $t_2$ is 50% smaller than the first thickness $t_1$.

In FIG. 8, the wall 16 extends only partly around the tubular metal part 7, and thus the fluid channel 12 has an extension along the longitudinal extension L and an extension along a circumference C of the tubular metal part 7 being at least 5% of the circumference of the tubular metal part 7, i.e. approximately 30% of the circumference of the tubular metal part 7 in FIG. 8. In other aspects, the fluid channel 12 has an extension along the circumference C of the tubular metal part 7 being at least 10% of the circumference of the tubular metal part 7, preferably at least 25% of the circumference of the tubular metal part 7, and more preferably at least 50% of the circumference of the tubular metal part 7. In FIG. 8, the fluid channel 12 is a partly annular fluid channel when seen in cross-section, and thus the fluid channel 12 has a moon-shaped cross-section. The wall 16 only partly surrounds the tubular metal part 7 and is connected to the tubular metal part 7 along a longitudinal extension of the tubular metal part 7, e.g. by welding.

In FIG. 4, the wall 16 has an outer face 19 and an inner face 20, and the inner face 20 of the wall 16 is arranged at a distance d of 0.5-3.0 mm from an outer face 21 of the tubular metal part 7, providing the fluid channel 12.

When expanding the expandable metal sleeve 8, pressurised fluid enters the expandable space 18 and thus provides pressure on the wall 16/tubular sleeve 17, and the wall 16/tubular sleeve 17 may bend slightly inward, which may induce permanent deformation of the wall 16/tubular sleeve 17 and thus block the fluid channel 12. In order to prevent the fluid channel 12 from being blocked, the wall 16 of the annular barrier 1 has a spacer part 22, as shown in FIGS. 9-11, ensuring a distance d between the inner face 20 of the wall 16 and the outer face 21 of the tubular metal part 7 also when the expandable metal sleeve 8 is expanded by pressurising the space between the wall 16 and the expandable metal sleeve 8. In FIG. 9, the spacer part 22 is a welded seam 28 along the axial extension of the tubular metal part 7 forming a projection 29 inwardly towards the tubular metal part so as to join the sides of a metal plate into the tubular sleeve 17. In FIG. 10, the spacer part 22 is several indentations 27 which may be formed by stamping. As can be seen, the indentations 27 are distributed at least along the longitudinal extension of the tubular metal part 7, e.g. in four rows as shown in FIG. 11, or in eight rows as shown in FIG. 10. Only one row of indentations along the axial extension of the tubular metal part 7 may be needed in order to keep the fluid channel 12 open also after the expandable metal sleeve 8 has been expanded by pressurising the space between the wall 16 and the expandable metal sleeve 8.

The annular barrier 1 further comprises a first connection part 30 connecting the expandable metal sleeve 8 to the tubular metal part 7, as shown in FIG. 4. The first connection part 30 comprises a first conduit 31 fluidly connecting the third opening 6 of the valve assembly 10 and the expandable space 18 within the expandable metal sleeve 8 in order to expand the expandable metal sleeve, and as shown in FIG. 5 (showing another cross-sectional view of part of the annular barrier) the first connection part 30 also comprises a second conduit 32 fluidly connecting the valve assembly 10 and the fluid channel 12 in order to connect the second zone with the valve assembly. The first connection part 30 connects the expandable metal sleeve 8 and the sheet-shaped wall 16 to the tubular metal part 7. The expandable metal sleeve 8 is welded to the first connection part 30, and the wall 16 is also welded to the first connection part 30. In FIG. 6, the annular barrier 1 further comprises a second connection part 33 connecting the expandable metal sleeve 8 and the wall 16 to the tubular metal part 7, and the second connection part comprises a third conduit 34 fluidly connecting the fluid channel 12 and the second zone 102. Thus, the third conduit 34 is in fluid communication with the second zone 102 at one end and fluidly connected to the fluid channel 12 at the other end, and the fluid channel 12 is fluidly connected to the second conduit 32. The second conduit 32 is further fluidly connected to the second opening 15 of the valve assembly 10. The expandable space 18 between the expandable metal sleeve 8 and the wall 16 is fluidly connected to the first conduit 31, and the first conduit 31 is fluidly connected with the first opening 14 being fluidly connected with the first zone 101 or the second opening 15 being fluidly connected with the second zone 102 in the expanded condition of the annular barrier 1, whatever pressure in the first or second zone is the higher.

The fourth opening 23 of the valve assembly 10 is fluidly connected with the expandable space 18 during expansion of the expandable metal sleeve 8, and after expansion the fourth opening 23 is fluidly disconnected from the expandable space 18. The valve assembly 10 comprises a first position in which the first opening 14 is fluidly connected with the expandable space 18 and a second position in which the second opening 15 is fluidly connected with the expandable space 18. In the first position, the pressure in the first zone 101 is higher than the pressure in the second zone 102, and in the second position the pressure in the second zone 102 is higher than the pressure in the first zone 101. In the first position and in the second position, the fourth opening 23 is fluidly disconnected from the expansion opening 11. In the expansion position, the valve assembly fluidly connects the expansion opening 11 and the expandable space. The valve assembly may be positioned in the expansion position when running the annular barrier and the well tubular metal structure in hole, or the valve assembly may be positioned in the first or second position when running in hole in order to ensure that the expandable space is pressure equalised with the annulus during running in hole. In expansion position, pressurised fluid from within the tubular metal part enters expansion opening 11 and further into fourth opening 23 through the first conduit 31.

As shown in FIG. 5, the annular barrier 1 further comprises a first screen 35 for filtering fluid from the first zone 101 before entering the first opening 14 of the valve assembly 10, and in FIG. 6 the annular barrier 1 further comprises a second screen 36 for filtering fluid from the second zone 102 before entering the third conduit 34, the fluid channel 12 and then the valve assembly 10.

When mounted to the well tubular metal structure 3, the annular barrier 1 forms a downhole system 100. The downhole system 100 may comprise more than one annular barrier 1.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil, and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. An annular barrier to be expanded in an annulus between a well tubular metal structure and an inside wall of a borehole downhole to an expanded condition of the annular barrier providing zone isolation between a first zone and a second zone of the borehole, the annular barrier having an unexpanded condition, and the expanded condition comprising:

a tubular metal part for mounting as part of the well tubular metal structure, an expandable metal sleeve surrounding the tubular metal part, each end of the expandable metal sleeve being connected with the tubular metal part defining an expandable space, the expandable metal sleeve having a first thickness, an expansion opening in the tubular metal part through which fluid enters in order to expand the expandable metal sleeve, and a valve assembly having a first opening fluidly connected with the first zone in the expanded condition of the annular barrier, a second opening fluidly connected with the second zone through a fluid channel between the tubular metal part and the expandable metal sleeve, and a third opening fluidly connected with the expandable space, wherein the fluid channel has an extension along a circumference of the tubular metal part being at least 5% of the circumference of the tubular metal part.

2. The annular barrier according to claim 1, wherein the fluid channel is provided by a sheet-shaped wall arranged between the tubular metal part and the expandable metal sleeve, and each end of the sheet-shaped wall is arranged between the tubular metal part and each end of the expandable metal sleeve, respectively.

3. The annular barrier according to claim 2 wherein the wall has a second thickness being smaller than the first thickness.

4. The annular barrier according to claim 3, wherein the wall extends along at least part of the circumference of the tubular metal part and along an axial extension of the tubular metal part.

5. The annular barrier according to claim 3, wherein the fluid channel is provided by a tubular sleeve having the wall and surrounding the tubular metal part and being arranged within the expandable metal sleeve, providing the fluid channel.

6. The annular barrier according to claim 5, wherein the tubular sleeve is immobile at least after expansion of the expandable metal sleeve.

7. The annular barrier according to claim 5, wherein the fluid channel is arranged between the tubular sleeve and the tubular metal part, and the expandable metal sleeve surrounds the tubular sleeve defining the expandable space between the expandable metal sleeve and the tubular sleeve, and the valve assembly controls a pressure in the expandable space.

8. The annular barrier according to claim 3, wherein the second thickness is between 1-5 mm.

9. The annular barrier according to claim 8, wherein the second thickness is between 1-3 mm.

10. The annular barrier according to claim 3, wherein the second thickness is 50% smaller than the first thickness.

11. The annular barrier according to claim 2, wherein the wall has an outer face and an inner face, and the inner face of the wall is arranged at a distance of 0.5-3 mm from an outer face of the tubular metal part.

12. The annular barrier according to claim 2, wherein the wall has a spacer part ensuring a distance between an inner face of the wall and an outer face of the tubular metal part.

13. The annular barrier according to claim 1, wherein the fluid channel is an annular fluid channel when seen in cross-section perpendicular to the longitudinal extension.

14. The annular barrier according to claim 1, further comprising a first connection part connecting the expandable metal sleeve to the tubular metal part, the first connection part comprising a first conduit fluidly connecting the third opening of the valve assembly and the expandable space, and the first connection part comprising a second conduit fluidly connecting the second opening of the valve assembly and the fluid channel.

15. The annular barrier according to claim 1, further comprising a second connection part connecting the expandable metal sleeve to the tubular metal part, the second connection part comprising a third conduit fluidly connecting the fluid channel and the second zone.

16. The annular barrier according to claim 1, further comprising a first screen for filtering fluid from the first zone before entering the valve assembly or a second screen for filtering fluid from the second zone before entering the valve assembly.

17. Downhole system comprising at least one annular barrier according to claim 1 and the well tubular metal structure.

18. The annular barrier according to claim 1, further comprising a first screen for filtering fluid from the first zone before entering the valve assembly and a second screen for filtering fluid from the second zone before entering the valve assembly.

* * * * *